US009982961B1

(12) United States Patent
Rentz

(10) Patent No.: US 9,982,961 B1
(45) Date of Patent: May 29, 2018

(54) ARCHERY RELEASE

(71) Applicant: Gregory E. Summers, Madison Heights, VA (US)

(72) Inventor: Marc T. Rentz, Madison Heights, VA (US)

(73) Assignee: Gregory E. Summers, Madison Heights, VA (US)

( * ) Notice: Subject to any disclaimer, the term of this patent is extended or adjusted under 35 U.S.C. 154(b) by 0 days. days.

(21) Appl. No.: 15/687,804

(22) Filed: Aug. 28, 2017

(51) Int. Cl.
*F41B 5/18* (2006.01)
*F41B 5/14* (2006.01)

(52) U.S. Cl.
CPC ..... *F41B 5/1469* (2013.01)

(58) Field of Classification Search
CPC ..... F41B 5/1469
See application file for complete search history.

(56) References Cited

U.S. PATENT DOCUMENTS 3,937,206 A * 2/1976 Wilson ..... F41A 19/16 124/35.2
4,004,564 A * 1/1977 Castonguay ..... F41B 5/1469 124/35.2
5,103,796 A * 4/1992 Peck ..... F41B 5/1469 124/35.2
6,571,786 B2 * 6/2003 Summers ..... F41B 5/1469 124/35.2
6,584,966 B1 * 7/2003 Summers ..... F41B 5/1469 124/35.2
6,631,709 B2 * 10/2003 Carter ..... F41B 5/1469 124/35.2
6,647,976 B2 * 11/2003 Summers ..... F41B 5/1469 124/35.2
8,622,051 B2 1/2014 Summers et al.
9,027,540 B2 * 5/2015 Springer ..... F41B 5/1469 124/31
9,557,133 B2 1/2017 Rentz

* cited by examiner

*Primary Examiner* — John Ricci
(74) *Attorney, Agent, or Firm* — Leading-Edge Law Group, PLC

(57) ABSTRACT

A handheld archery release is convertible between hinge and trigger modes of operation. The release includes a handle which contains a sear assembly operable between hold and fire positions. Hinge and trigger assemblies are connected with the handle and with the sear assembly to operate the sear assembly in both modes of operation. A linkage assembly is connected with the handle and rotates the sear assembly toward the fire position when the trigger assembly is operated and biases the sear assembly in a first direction when the hinge assembly is operated.

19 Claims, 13 Drawing Sheets

ARCHERY RELEASE

BACKGROUND OF THE INVENTION

The present invention relates to an archery release, and more particularly to a convertible handheld archery release for a bowstring which is operable in both trigger and hinge modes.

Release devices are used in archery to assist the archer in pulling a bowstring to a fully drawn position and then releasing the bowstring to fire an arrow. Some release devices use a trigger to fire a shot, which can lead to less accuracy due to the archer knowing when the shot is fired, resulting in flinching or punching the trigger. Still other devices use back tension to fire the shot, where the archer is not aware of when the shot will fire because there is no trigger. A back tension firing motion cannot be anticipated, resulting in greater accuracy due to the shot going off without the archer flinching, punching or otherwise pulling the bow off target during the time period that the arrow is being propelled by the bowstring. The present invention relates to a new handheld release which can be used in both hinge style back tension and trigger shooting methods.

BRIEF DESCRIPTION OF THE PRIOR ART

Back-tension release devices are well-known in the prior art as evidenced by U.S. Pat. No. 8,622,051 which discloses a release with an adjustable sear housing and an adjustable finger. By adjusting the sear housing, twist or torque in a bowstring loop connected with the release can be eliminated. The speed of the release is altered via adjustment of the finger.

U.S. Pat. No. 9,557,133 discloses a handheld archery release including a hinged handle. The handle includes first and second members which are gripped by and archer. The second member is connected with the first member for movement about a pivot axis normal to a longitudinal axis of the handle to operate the release.

While the prior devices normally operate satisfactorily, they are somewhat limited in that they are operable only via hinge movement. In certain situations, it is desirable to operate a release via a trigger rather than via a hinge to accommodate various shooting styles.

SUMMARY OF THE INVENTION

The present archery release was developed in order to overcome these and other drawbacks of prior archery releases by providing a release that is convertible between hinge and trigger modes of operation. The release includes a handle having a longitudinal axis and a sear assembly connected with the handle and operable between hold and fire positions. The sear assembly includes a sear and a hook. A trigger assembly is connected with the handle to operate the sear assembly in a trigger mode of operation and a hinge assembly is connected with the handle to operate the sear assembly in a hinge mode of operation. A linkage assembly is also connected with the handle for rotating the sear toward the fire position when the trigger assembly is operated and for biasing the sear in a first direction when the hinge assembly is operated.

The trigger assembly includes a trigger pivotally connected with the handle and operable to activate the linkage assembly in the trigger mode of operation. The linkage assembly includes a cocking bar pivotally connected with the handle and operable between cocked and release positions. The cocking bar includes a first portion which engages the trigger when the cocking bar is in the cocked position. The linkage assembly further includes a secondary link pivotally connected with the handle and engaging the sear. The cocking bar is released by operation of the trigger by the archer and pivots the secondary link to rotate the sear. A first spring is arranged between the handle and the cocking bar to bias the cocking bar to the release position when the trigger is operated to disengage the first portion of the locking bar, and a second spring is arranged between the handle and the secondary link to bias the secondary link against the cocking bar.

The hinge assembly includes a cage that is pivotally connected with the handle and rotatable relative to the sear to release the hook. An adjustable screw is connected with the handle and engages the sear to rotate the sear relative to the cage to control the release point of the hook. The linkage assembly biases the sear against the adjustable screw.

Locking screws are provided to lock the trigger relative to the handle when the hinge assembly is operable in the hinge mode of operation and to lock the sear in a given position as set by the adjustable screw. A locking assembly is also provided to lock the cage in a fixed position relative to the handle when the release is in the trigger mode of operation.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
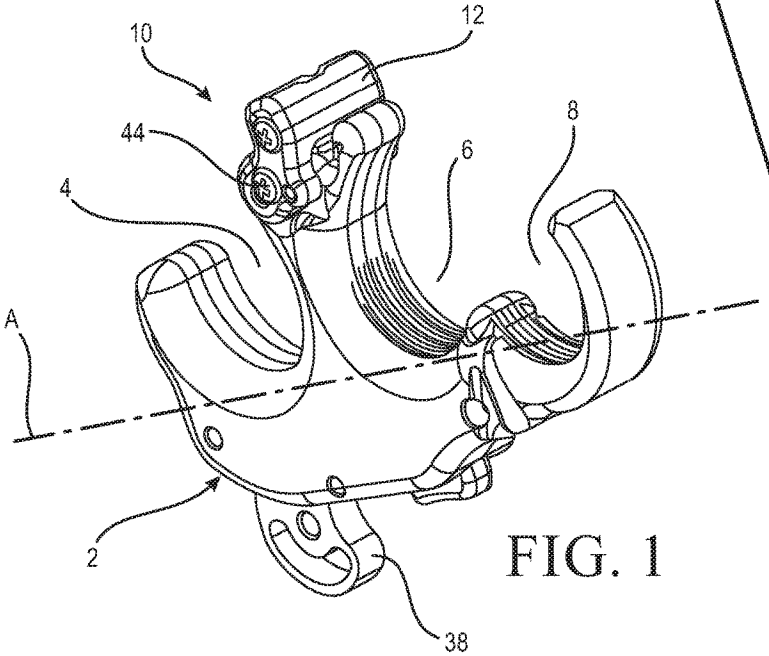
FIG. 1 front perspective view of the archery release according to the disclosure.
Figure 2:
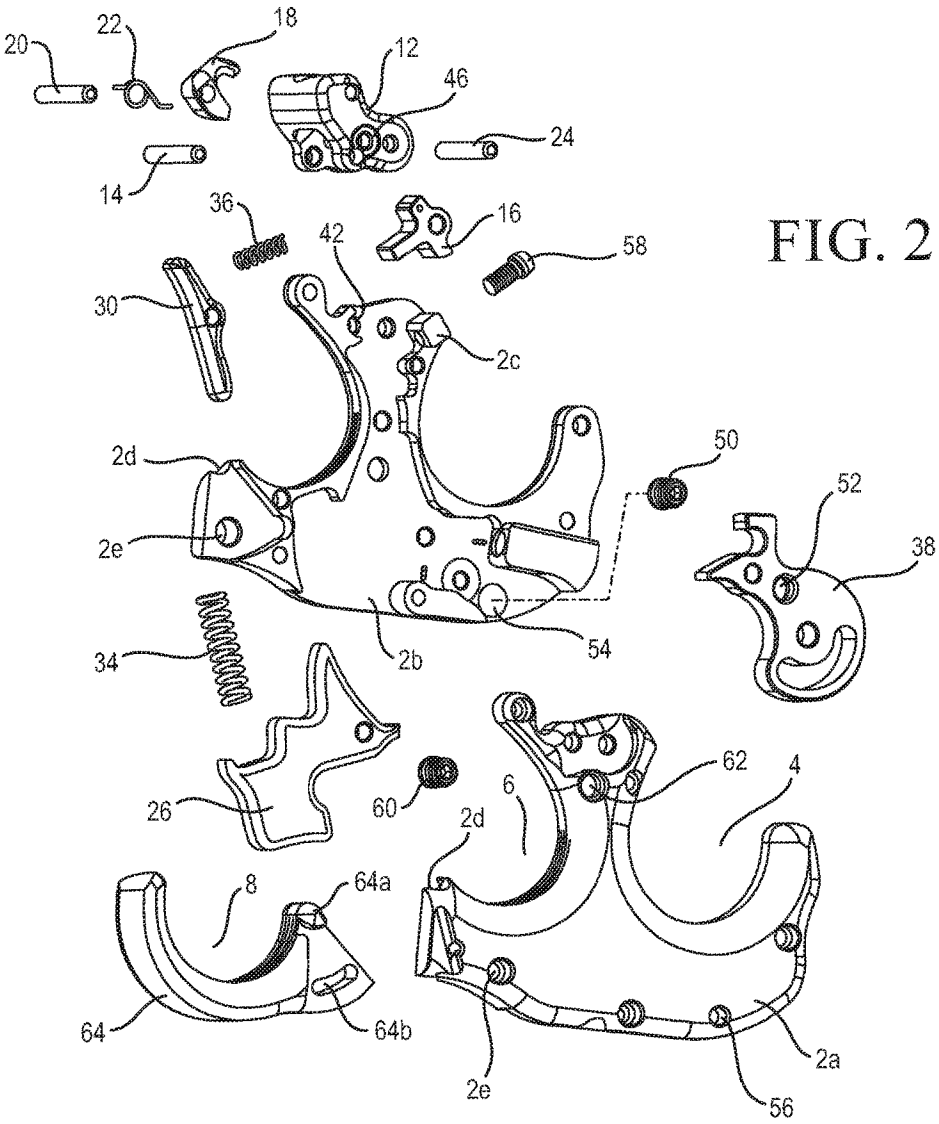
FIG. 2 is an exploded view of the archery release.

As shown in FIGS. 1 and 2, the handheld convertible archery release includes a number of components which are shown in greater detail in FIGS. 7-12 and 14-18. More particularly, the release includes a handle 2 having a longitudinal axis A. The handle is formed from two mating generally concave sections which when joined define a chamber within the handle as shown in FIG. 2. A first or front section 2*a* is shown in detail in FIGS. 17*a-e* and a second or rear section 2*b* is shown in detail in FIGS. 18*a-e*. The handle sections contain openings which are aligned when the sections are brought together in contiguous relation for receiving screws or other fastening devices (not shown) to connect the handle sections together. The handle includes recesses in one surface thereof for receiving the fingers of an archer. A first recess 4 is adapted to receive the index finger of the archer and a second recess 6 is adapted to receive the middle finger. An optional third recess 8 receives the ring finger. As will be developed below, the handle is convertible between hinge and trigger modes of operation.

Between two of the first 4 and second 6 finger recesses, a head portion 10 of the handle includes a cage 12 rotatably connected with the handle by a pivot pin 14 and a sear assembly including a sear 16 pivotally connected with the handle and cage by the pivot pin 14 and a bowstring hook 18 rotatably connected with the cage by a pivot pin 20 as shown in FIG. 2. A spring element 22 normally biases the hook to a hold position. The hook is released to a fire position upon operation of the sear as will be developed in greater detail below. The cage, sear, and hook all rotate or pivot about axes which are parallel to each other and normal to the longitudinal axis of the handle.

The cage 12 is shown in greater detail in FIGS. 7*a-d*. As shown therein, it has a generally U-shaped configuration including a lateral portion 12*a* and a pair of spaced leg portions 12*b*. The lower portions of the leg portions contain first aligned openings 12*c*, respectively, for receiving the pivot pin 14 and second aligned openings 12*d*, respectively, for receiving a removable dowel 24 (FIGS. 2 and 13) as will be described below. The upper portions of the cage leg portions contain third aligned openings 12*e* for receiving the hook pivot pin 20.

The sear 16 is shown in greater detail in FIGS. 8*a-d*. It contains a lateral opening 16*a* for receiving the pivot pin 14. The sear is generally configured as a cross with first and second wing portions 16*b*, 16*c*, an extension 16*d*, and a curved surface 16*e* opposite the extension. A small notch 16*f* is cut into a surface of the wing portion 16*b* of the sear.

Figure 9B:
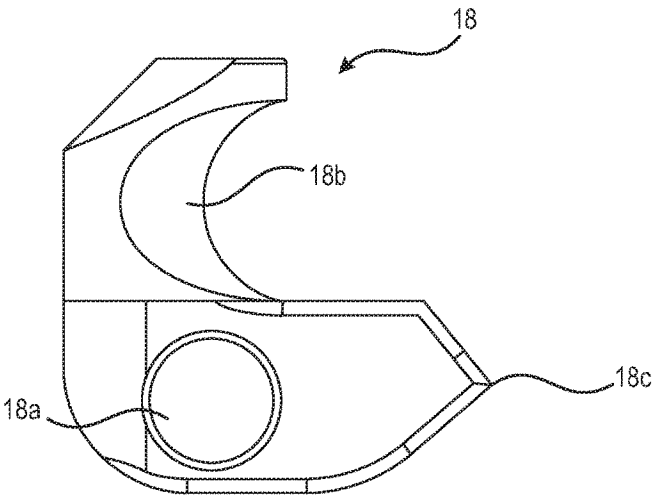
FIGS. 9*a*, 9*b*, and 9*c* are front perspective, front, and right side views, respectively, of the hook of the archery release.
Figure 9C:
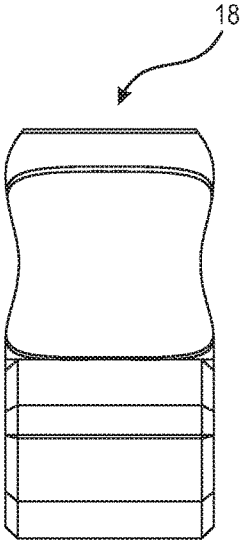
Figure 9A:
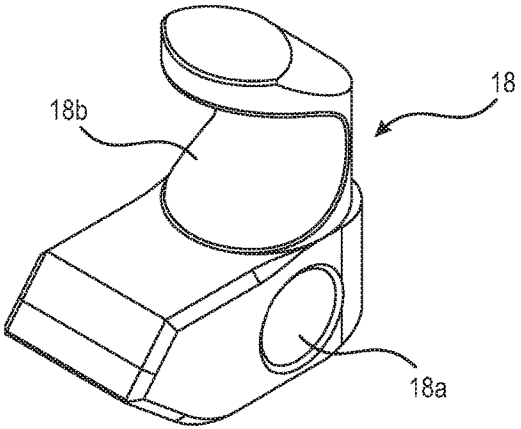
Figure 10B:
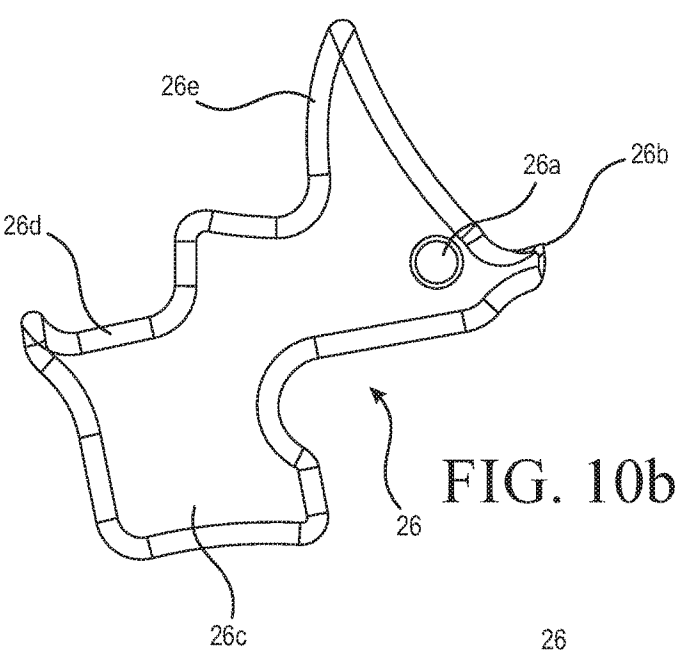
FIGS. 10*a*, 10*b*, 10*c*, and 10*d* are front perspective, front, right side and top views, respectively, of the trigger of the archery release.
Figure 10D:
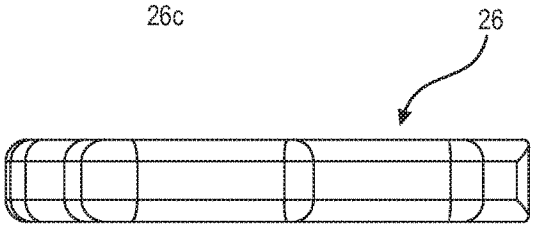
Figure 10A:
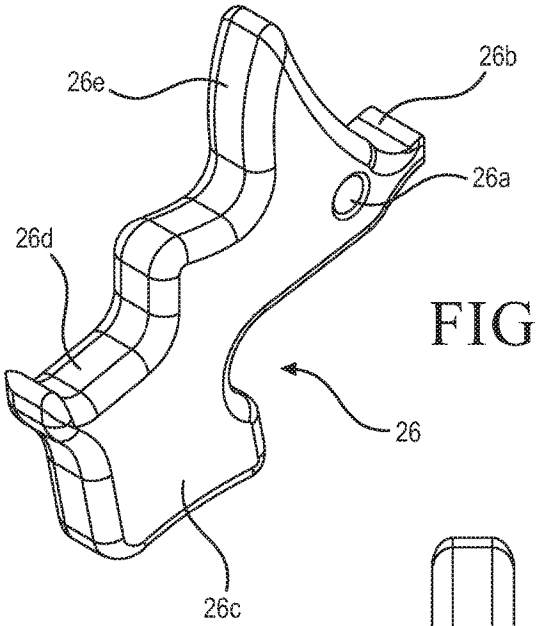
Figure 10C:
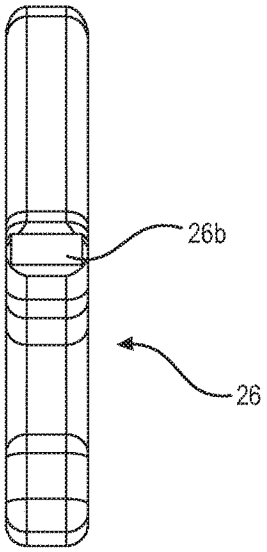
Figure 11B:
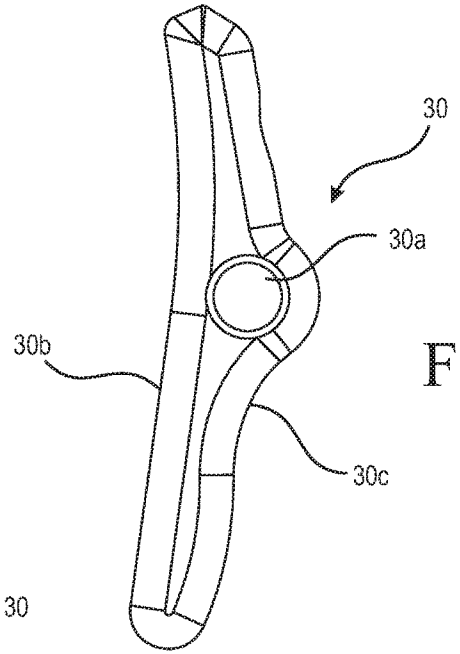
FIGS. 11*a*, 11*b*, 11*c*, and 11*d* are front perspective, front, right side and top views, respectively, of the cocking bar of the archery release.
Figure 11D:
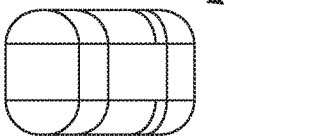
Figure 11C:
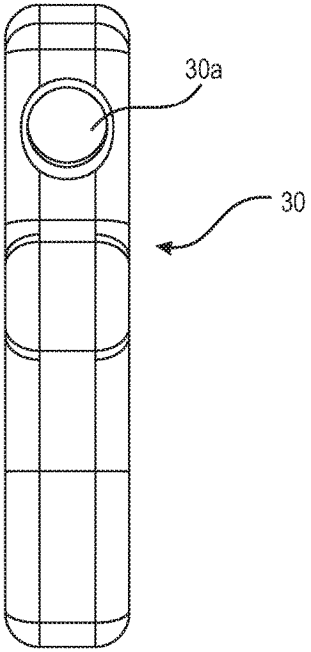
Figure 11A:
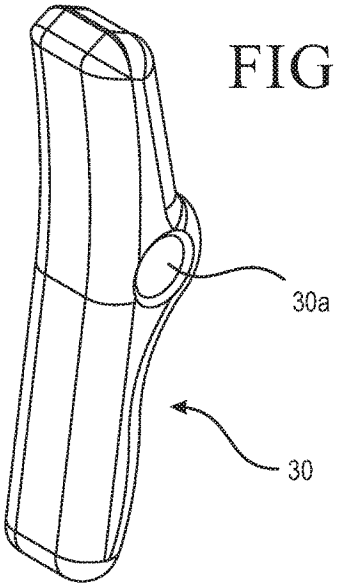
Figure 12B:
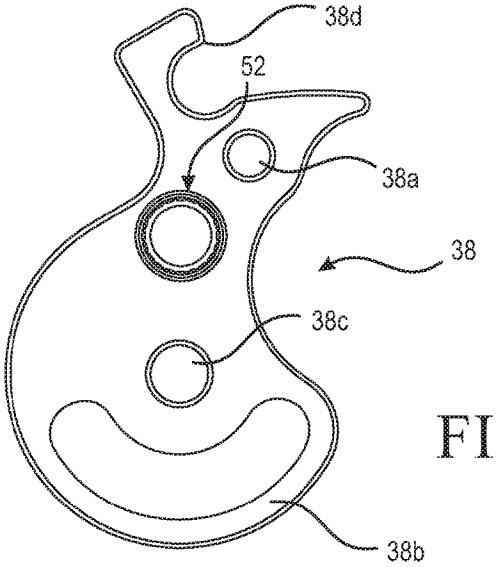
FIGS. 12*a*, 12*b*, 12*c*, and 12*d* are front perspective, front, right side and top views, respectively, of the secondary link of the archery release.
Figure 12D:
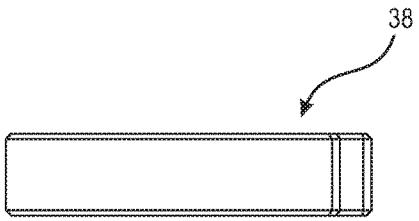
Figure 12C:
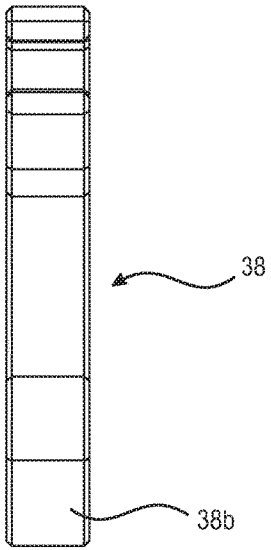
Figure 12A:
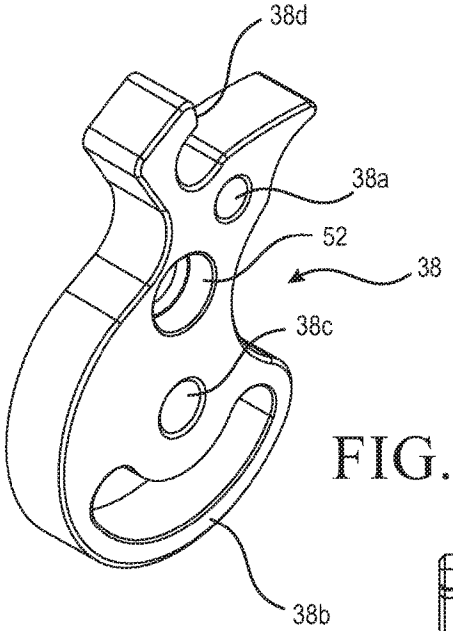

The hook 18 is shown in FIGS. 9*a-c*. It includes a lateral opening 18*a* for receiving the pivot pin 20 and a recess portion 18*b* for receiving a bowstring or bowstring loop of a bow. The hook further includes a tip portion 18*c* which cooperates with the notch 16*f* in the sear wing portion 16*b* as will be developed below. When the release is operated to a fire position, the bowstring is released from the hook to fire an arrow.

Referring now to FIGS. 2-6, the handle contains a linkage assembly which is operable to rotate the sear assembly toward the fire position when the release is in the trigger mode of operation and to bias the sear assembly in a first direction when the release is in the hinge mode of operation. The linkage assembly includes a cocking bar 26 connected with the handle about a pivot pin 28 and a secondary link 30 connected with the handle about a pivot pin 32.

Figures 3, 4:
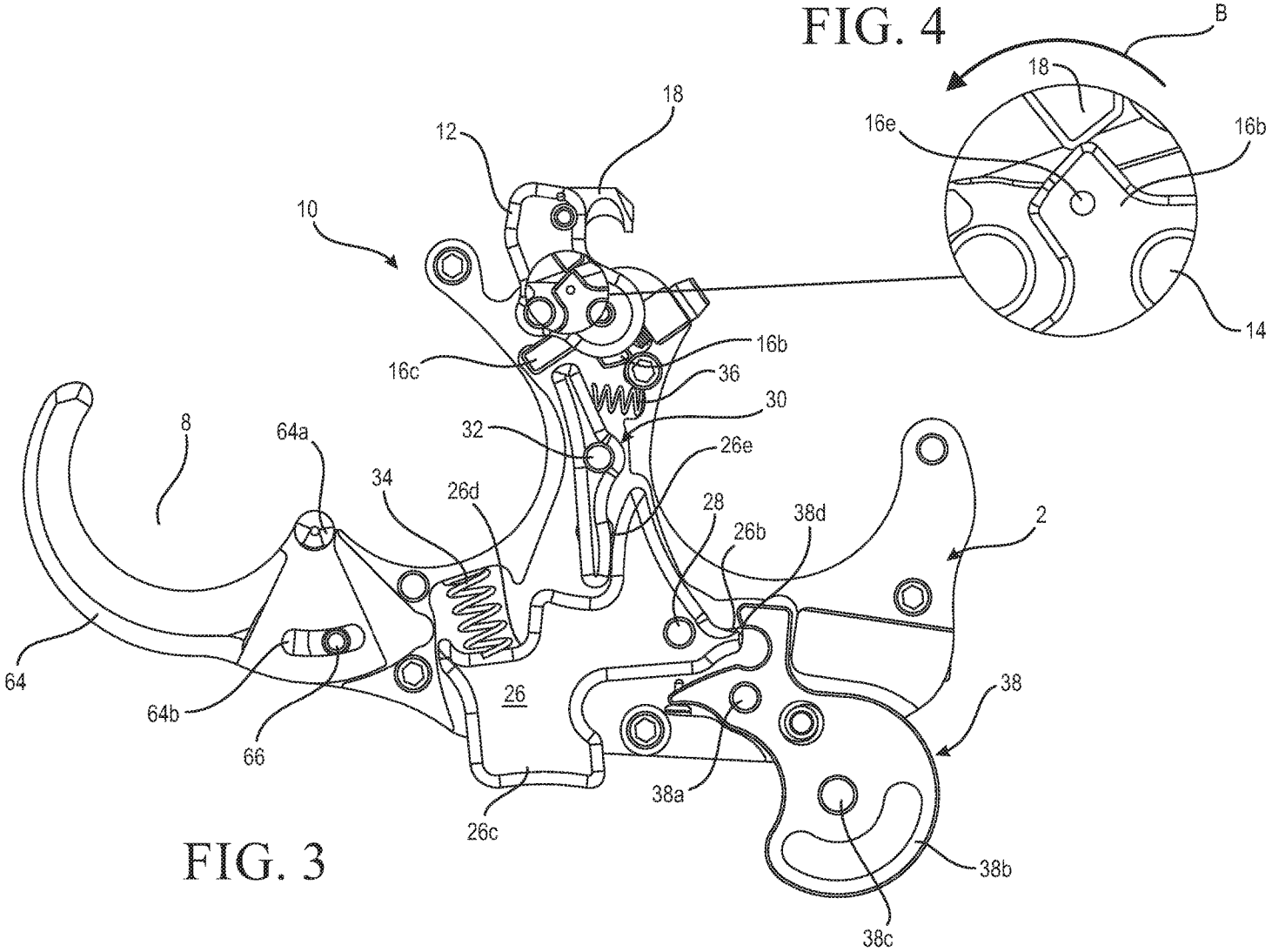
FIG. 3 is a cutaway view of the archery release for operation in the trigger mode.
FIG. 4 is a detailed cutaway view of a portion of the sear from FIG. 3.

The cocking bar 26 is shown in detail in FIGS. 10*a-d*. It includes an opening 26*a* at one end for receiving the pivot pin 28 and a catch portion 26*b* adjacent the opening. A lower portion 26*c* of the cocking bar extends from the handle via an opening as shown in FIG. 3.

The secondary link 30 is shown in detail in FIGS. 11*a-d*. It includes an opening 30*a* for receiving the pivot pin 32 of the handle. The opening is generally midway of the length of the secondary link. One elongated surface 30*b* of the link is slightly concave, and the opposite surface 30*c* is slightly convex.

The axes of the pivot pins 28 and 30 are parallel and normal to the longitudinal axis of the handle. A spring 34 is arranged between an interior wall of the handle and a surface 26*d* of the cocking bar above the lower portion 26*c* to bias the cocking bar in a counterclockwise direction in FIG. 3 about the pivot pin 28. An upper portion 26*e* of the cocking bar abuts against a lower portion of the surface 30*c* of the secondary link. A spring 36 is arranged between the interior wall of the handle and an upper portion of the surface 30*c* of the secondary link to bias the link in a counterclockwise direction in FIG. 3 about the pivot pin 32.

A trigger 38 is connected with the handle via a dowel 40. The trigger is shown in detail in FIGS. 12*a-d*. It contains an opening 38*a* for receiving the dowel 40. As shown in FIG. 3, a first portion 38*b* of the trigger extends from the handle via an opening in the handle sections. The first portion of the trigger contains an opening 38*c* within which a thumb pin (not shown) may be connected. The thumb pin may be connected with either side of the trigger for use by right or left-handed archers. Opposite the first portion, the trigger includes a catch portion 38*d* which is configured to engage the catch portion 26*b* of the cocking bar.

In the trigger mode operation, the archer cocks the cocking bar 26 by pressing the lower portion 26*c* against the bias force of the spring 34. This causes the catch portion 26*b* of the cocking bar to engage the catch portion 38*d* of the trigger. When the trigger is activated, the catch portion 26*b* of the cocking bar is released and the cocking bar rotates counterclockwise under the force of the spring 34. The cocking bar thus rotates the secondary link clockwise about the pivot pin 32 against the biasing force of the spring 36 which is less than the force of the spring 34 since the spring 36 is smaller than the spring 34. The upper end of the secondary link strikes against the wing 16*b* of the sear. The sear is thus rotated in a counterclockwise direction as shown by the arrow B to release the hook as shown in detail in FIG. 4 allowing the bow to shoot.

Figure 13:
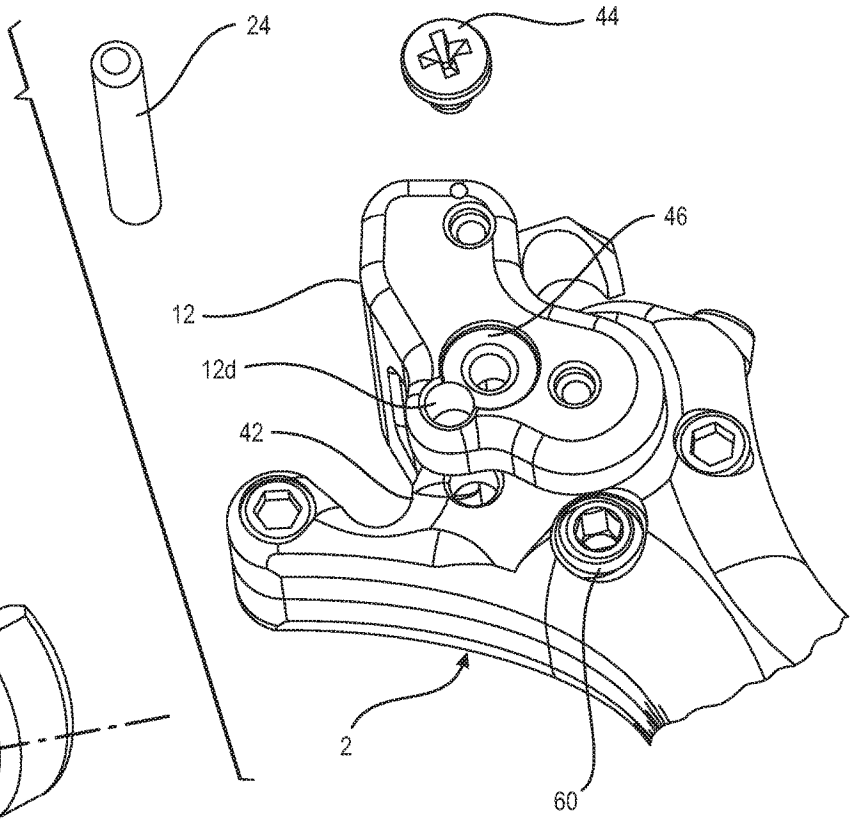
FIG. 13 is an exploded perspective view of the head portion of the archery release and the locking assembly for the cage.

The cage 12 is immobilized for trigger mode operation of the release. This is accomplished by inserting a dowel 24 into one of the openings 12*d* in the leg portions 12*b* of the cage as shown in FIG. 13. The one opening in the cage leg portion is a through opening and the opening in the other leg portion is only a partial opening. The dowel further passes through an opening 42 in the handle and then into the partial opening in the cage leg portion. More particularly, the handle opening includes through openings 42 in the first and second handle sections 2*a* and 2*b*. A pan head screw 44 is inserted into the aligned threaded opening 46 in the cage to retain the dowel 24 in place. The partial opening in the cage leg portion retains the other end of the dowel in place.

Figures 5, 6:
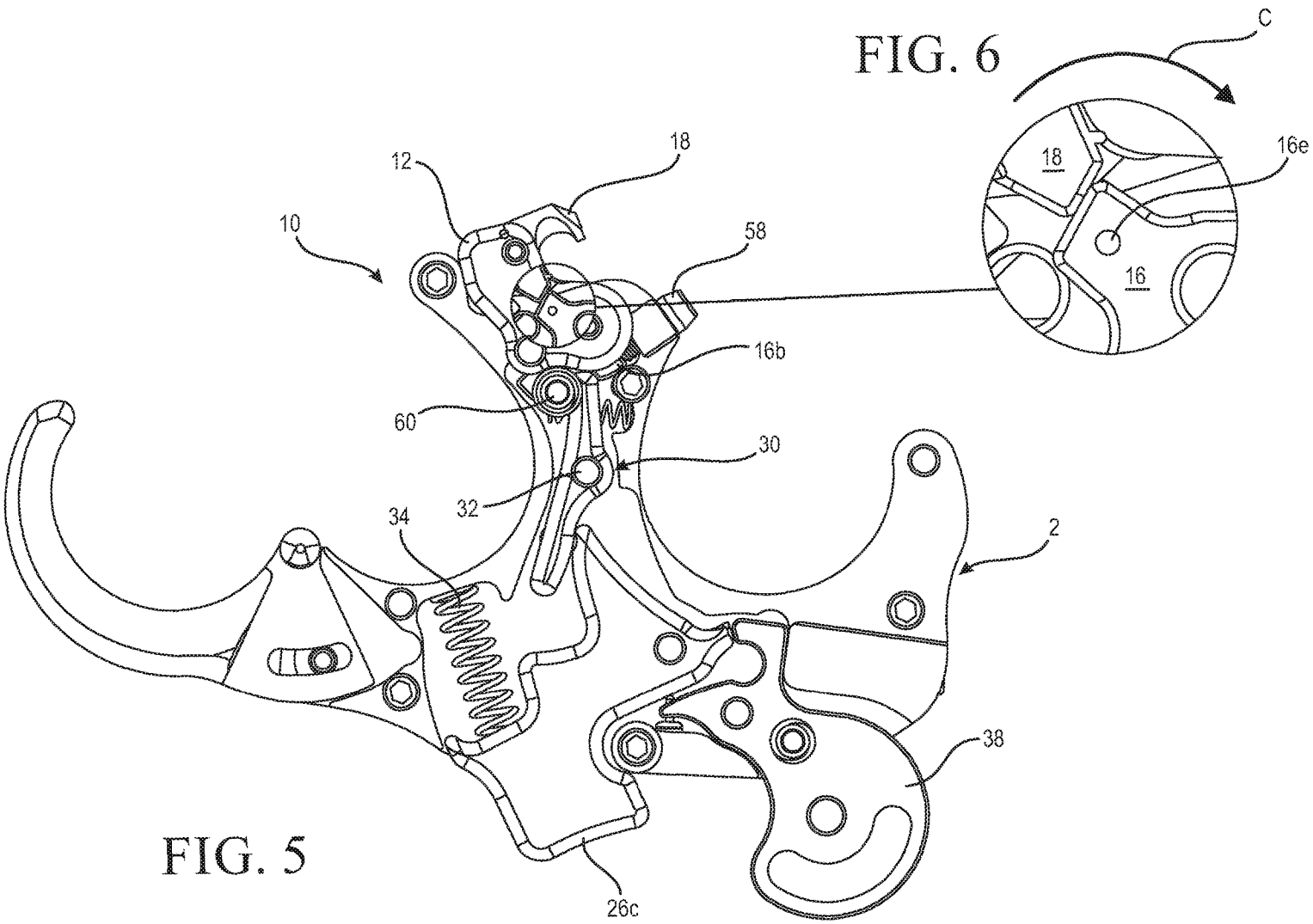
FIG. 5 is a cutaway view of the archery release for operation in the hinge mode.
FIG. 6 is a detailed cutaway view of a portion of the sear from FIG. 5.
Figure 7B:
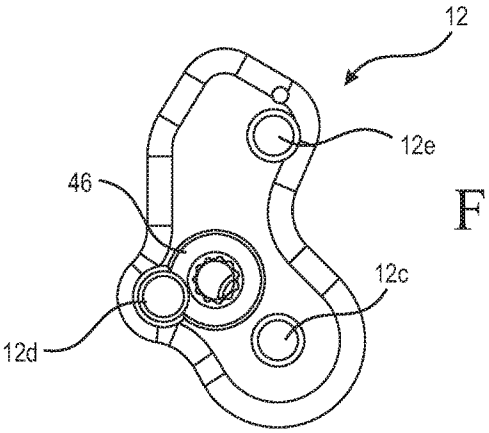
FIGS. 7*a*, 7*b*, 7*c*, and 7*d* are front perspective, front, right side and top views, respectively, of the cage of the archery release.
Figure 7D:
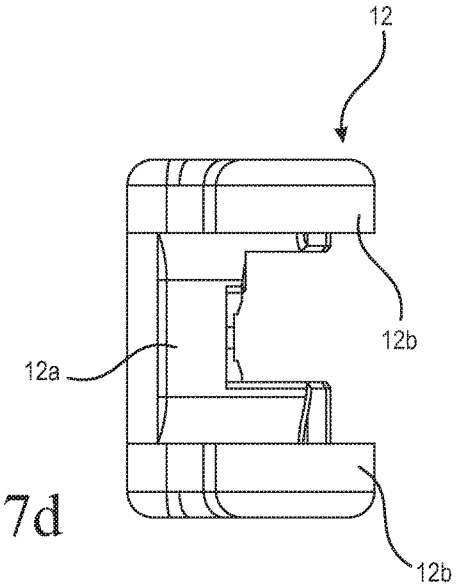
Figure 7A:
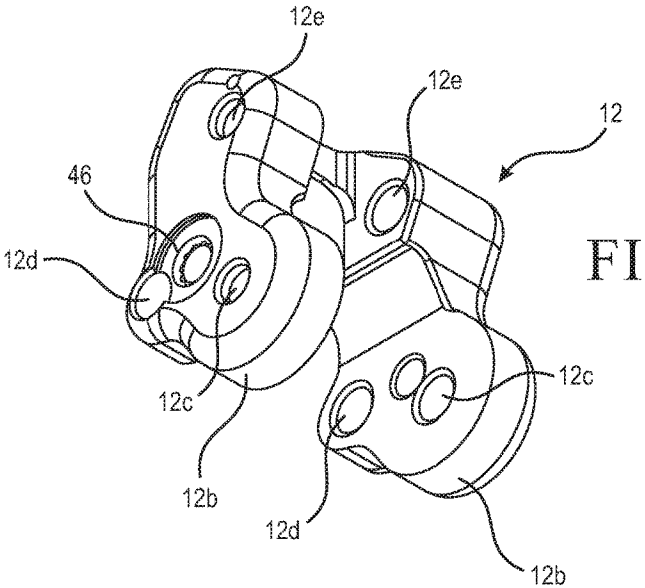
Figure 7C:
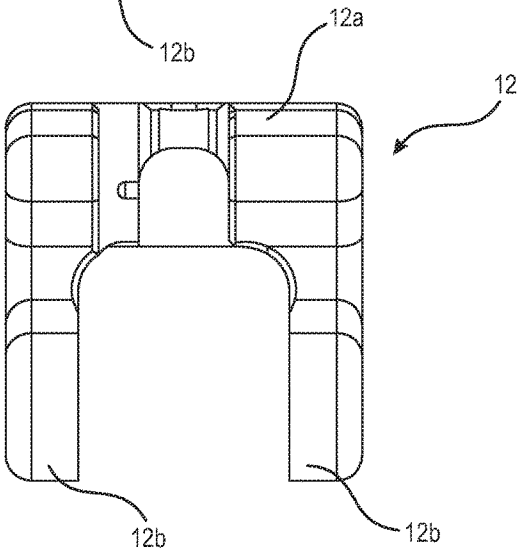
Figure 8B:
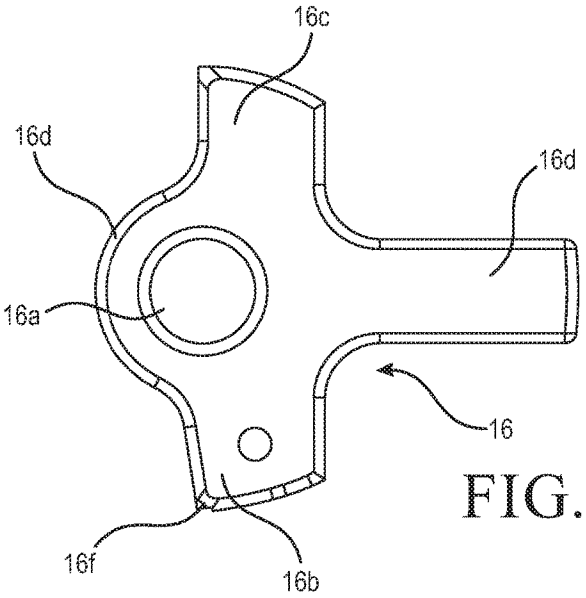
FIGS. 8*a*, 8*b*, 8*c*, and 8*d* are front perspective, front, right side, and top views, respectively, of the sear of the archery release.
Figure 8D:
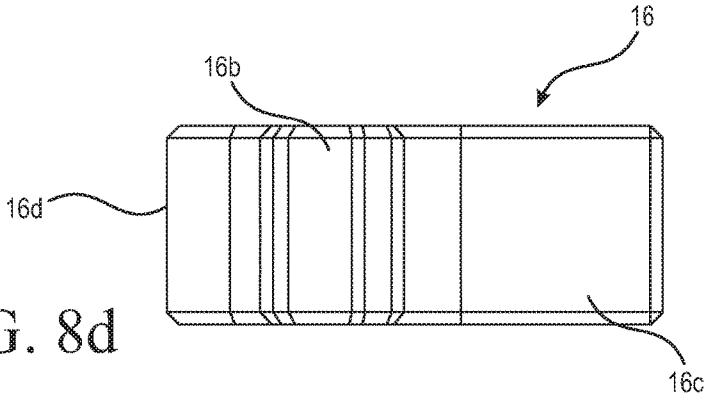
Figure 8A:
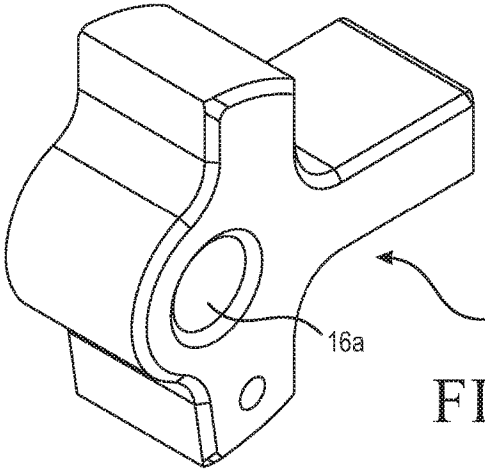
Figure 8C:
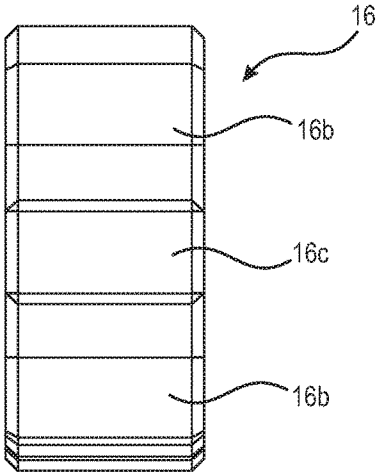
Figure 14C:
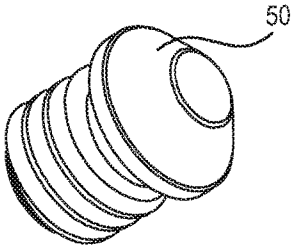
FIGS. 14*a*, 14*b*, and 14*c* are front, right side, and rear perspective views, respectively, of the trigger locking screw of the archery release.
Figure 15C:
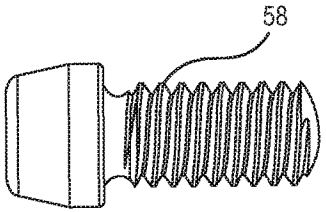
FIGS. 15*a*, 15*b*, and 15*c* are front perspective, top, and right side views, respectively, of the sear adjusting micro screw of the archery release.
Figure 16C:
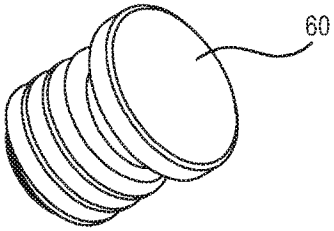
FIGS. 16*a*, 16*b*, and 16*c*, are front, right side, and rear perspective views, respectively, of the sear locking screw of the archery release.
Figure 14B:
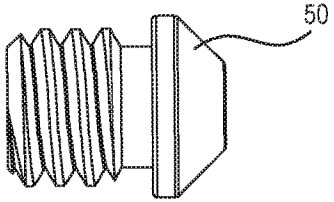
Figure 15B:
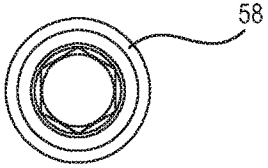
Figure 16B:
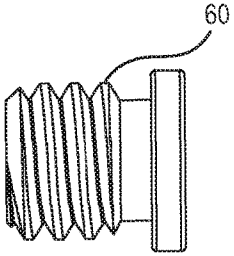
Figure 14A:
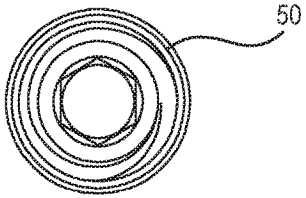
Figure 15A:
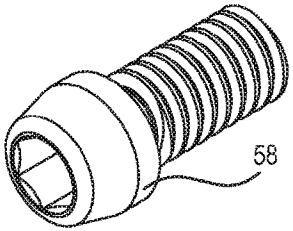
Figure 16A:
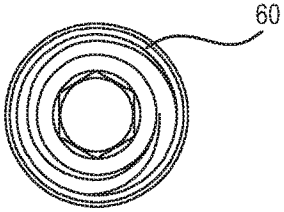
Figure 17A:
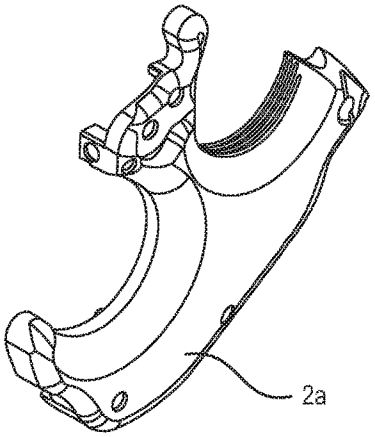
FIGS. 17*a*, 17*b*, 17*c*, 17*d*, and 17*e* are front perspective, front, right side, rear, and top views, respectively, of a first side portion of the handle of the archery release.
Figure 17B:
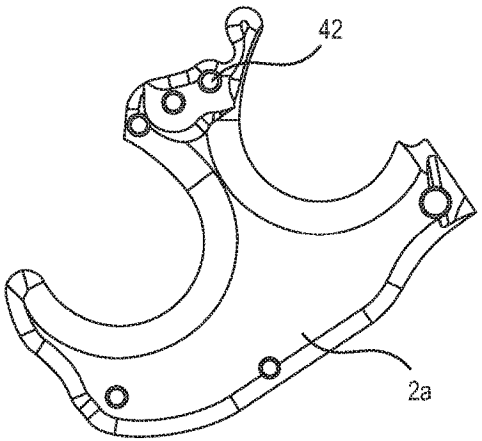
Figure 17C:
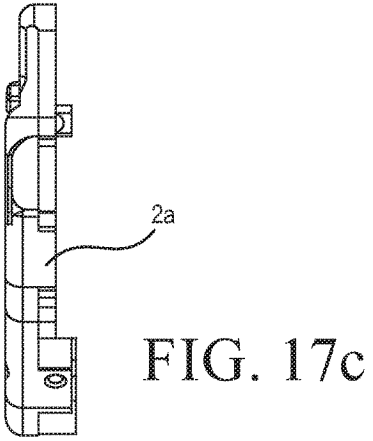
Figure 17D:
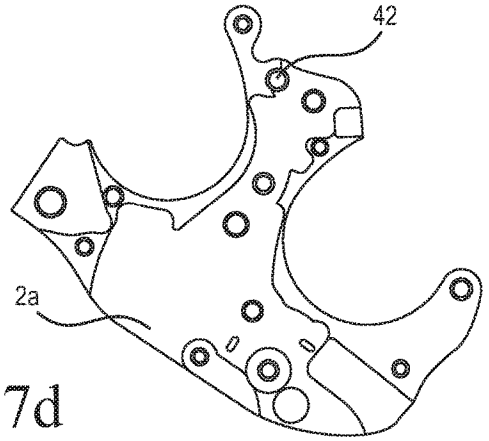
Figure 17E:
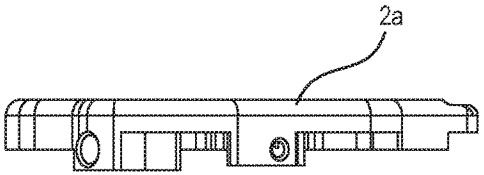
Figure 18C:
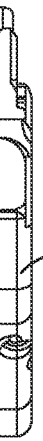
FIGS. 18*a*, 18*b*, 18*c*, 18*d*, and 18*e* are front perspective, front, right side, rear, and top views, respectively, of a second side portion of the handle of the archery release.
Figure 18B:
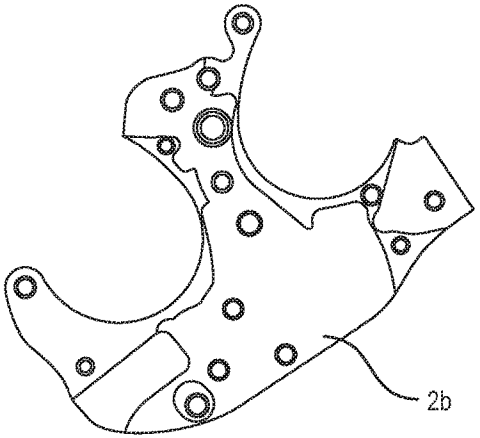
Figure 18A:
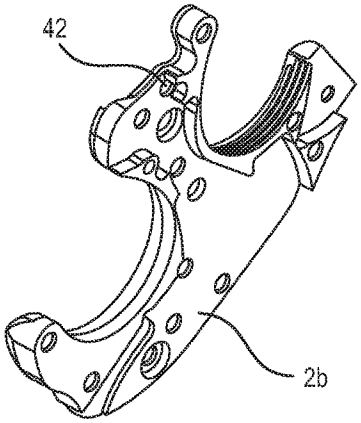
Figure 18E:
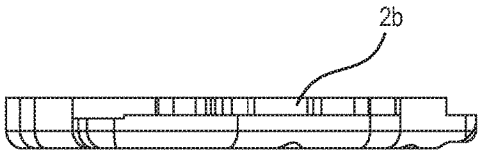
Figure 18D:
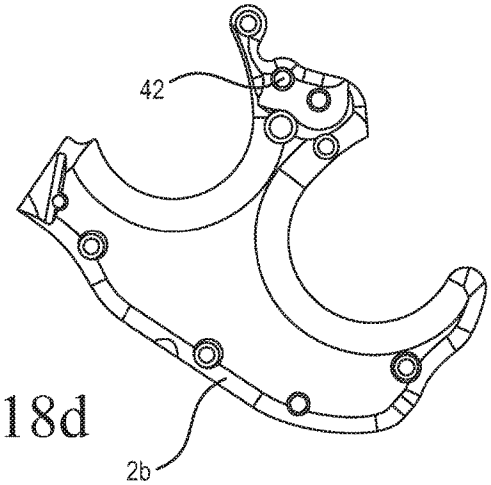

The hinge mode of operation of the release will be described with reference to FIGS. 5 and 6. In order to convert the release to hinge operation, the pan head screw 44 (FIG. 13) is removed from the cage opening 46 and the dowel 24 is removed, thereby allowing the cage to rotate relative to the handle. The dowel may be stored in a pocket 48 in the bottom of the handle section 2*b* as shown in FIGS. 18*c* and 18*e* and retained therein by the pan head screw 44. The trigger is immobilized by a locking screw 50. More particularly, the locking screw 50 is threaded into a threaded opening 52 in the trigger, and into a pocket 54 in the handle section 2*b* as shown in FIG. 2. The pocket 54 is not threaded. The opening 52 and the pocket 54 are in alignment to receive the locking screw 50. A hex wrench is inserted through an opening 56 in the handle section 2*b* and into the head of the locking screw 50 and rotated in a clockwise direction to lock the trigger in place. The trigger locking screw is shown in detail in FIGS. 14*a-c*. The pocket 54 is configured to receive the end of the locking screw. The pocket may have a cylindrical configuration or it may be tapered to match the configuration of the end of the screw as shown in FIGS. 14*b* and 14*c*.

The sear 16 is adjusted to the desired release position when the release is in the hinge mode of operation. This is accomplished with a micro adjust screw 58 which is shown in detail in FIGS. 15*a-c*. As shown in FIG. 2, the second handle section 2*b* contains a projection 2*c* which contains a threaded opening for receiving the micro adjust screw. The end of the screw 58 abuts against a wing 16*b* of the sear 16 as shown in FIG. 5. By further inserting the screw 58 into the handle projection 2*c*, the screw 58 rotates the sear in a clockwise direction against the upper end of the secondary link 30 against the biasing force of the secondary link which normally biases the link against the micro adjust screw as a result of the force of the spring 34. This reduces the speed of the hinge activation because it increases the distance the hook must be rotated to release the bowstring. Conversely, rotating the screw 58 away from the handle projection causes the sear to rotate in a counterclockwise direction so that the hook rotates less distance to release the bowstring. More particularly, as shown in FIG. 6, the head portion of the release rotates clockwise in the direction of the arrow C about the sear 16 to release the hook 18 when the release is in the hinge mode of operation. As noted above, the sear rotates about the hook when the release is in the trigger mode of operation. Once the release point of the sear has been adjusted by the micro adjust screw 58, the sear is locked in place by a sear lock screw 60 which is shown in detail in FIGS. 16*a-c*. For clarity, the sear lock screw is not shown in FIG. 3 for the trigger mode of operation of the release. The sear lock screw 60 is inserted into a threaded opening 62 in the handle and tightened against the sear leg 16*c*. Once adjusted, the release is operated in the hinge mode by rotating the head portion 10 of the release relative to the sear to release the hook and fire an arrow. During operation of the release in the hinge mode of operation, the hook tip portion 18*c* rides along the rotating sear surface 16*b* and drops into the notch 16*f* of the sear to produce an audible click. The sear is reversible so that the wing portion 16*c* provides a surface—without a notch—along which the hook tip portion rides during firing without producing an audible click.

As noted above, the third recess 8 in the handle for the ring finger of the archer is optional. In a preferred embodiment, this recess is arranged in a finger 64 that is connected with the handle as shown in FIGS. 1, 2, 3 and 5. Preferably, the finger is connected with the handle via a hinge connection. That is, the finger includes a hinge pin portion 64*a* that rests in a recess 2*d* in the handle sections 2*a* and 2*c*. The finger 64 further contains a slot 64*b* below the hinge pin portion. The slot is aligned with aligned threaded openings 2*e* in the handle sections. An adjustment screw 66 passes through the slot into the threaded openings to secure the finger at a selected angle relative to the handle at the preference of the archer.

While the preferred forms and embodiments of the invention have been illustrated and described, it will become apparent to those of ordinary skill in the art that various changes and modifications may be made without deviating from the inventive concepts set forth above.

What is claimed is:

1. An archery release convertible between two modes of operation, comprising a handle having a longitudinal axis;

a sear assembly connected with said handle and operable between hold and fire positions;

a trigger assembly connected with said handle to operate said sear assembly in a trigger mode of operation; and a hinge assembly connected with said handle to operate said sear assembly in a hinge mode of operation; and a linkage assembly connected with said handle for rotating said sear assembly toward the fire position when said trigger assembly is operated and for biasing said sear assembly in a first direction when said hinge assembly is operated.

2. An archery release as defined in claim 1, and wherein said sear assembly includes a sear and a hook.

3. An archery release as defined in claim 2, wherein said trigger assembly includes a trigger pivotally connected with said handle and operable to activate said linkage assembly in the trigger mode of operation.

4. An archery release as defined in claim 3, wherein said linkage assembly includes a cocking bar pivotally connected with said handle and a secondary link pivotally connected with said handle and engaging said sear, said cocking bar being released by said trigger and pivoting said secondary link to rotate said sear.

5. An archery release as defined in claim 4, wherein said cocking bar is operable between cocked and release positions, said cocking bar including a first portion which engages said trigger when said cocking bar is in the cocked position.

6. An archery release as defined in claim 5, and further comprising a first spring arranged between said handle and said cocking bar to bias said cocking bar to said release position when said trigger is operated to disengage said first portion of said locking bar.

7. An archery release as defined in claim 6, and further comprising a second spring arranged between said handle and said secondary link to bias said secondary link against said cocking bar.

8. An archery release as defined in claim 7, and further comprising a locking screw for locking said trigger relative to said handle when said hinge assembly is operable in the hinge mode of operation.

9. An archery release as defined in claim 2, wherein said hinge assembly includes a cage pivotally connected with said handle and rotatable relative to said sear to release said hook.

10. An archery release as defined in claim 9, and further comprising an adjustable screw connected with said handle and engaging said sear to rotate the sear relative to said cage to control a release point of said hook.

11. An archery release as defined in claim 10, and further comprising a locking screw for locking said sear in a given position as set by said adjustable screw.

12. An archery release as defined in claim 10, wherein said linkage assembly biases said sear against said adjustable screw.

13. An archery release as defined in claim 12, wherein said linkage assembly includes a secondary link pivotally connected with said handle and having a first end abutting against said sear.

14. An archery release as defined in claim 13, wherein said linkage assembly further includes a cocking bar pivotally connected with said handle and abutting against a second end of said secondary link to pivot said secondary link against said sear.

15. An archery release as defined in claim 14, and further comprising a spring normally biasing said cocking bar against said secondary link to pivot said secondary link against said sear.

16. An archery release as defined in claim 15, and further comprising a trigger pivotally connected with said handle, said secondary link, cocking bar, spring and trigger comprising said trigger assembly.

17. An archery release as defined in claim 9, and further comprising a locking assembly for locking said cage in a non-rotatable position relative to said handle when said release is in the trigger mode of operation.

18. An archery release as defined in claim 17, wherein said handle and said cage contain aligned openings, and further wherein said locking assembly comprises a dowel which passes through said aligned openings to prevent movement of said cage relative to said handle.

19. An archery release as defined in claim 1, wherein said handle comprises a pair of concave mating handle portions which define an internal cavity which contains at least a portion of said hinge and trigger assemblies.

* * * * *